United States Patent [19]

Kapecki et al.

[11] 4,414,307

[45] Nov. 8, 1983

[54] METHOD AND COMPOSITION FOR PREPARATION OF PHOTOGRAPHIC COLOR DEVELOPING SOLUTIONS

[75] Inventors: Jon A. Kapecki; Thomas M. Gormel; Sheridan E. Vincent, all of Rochester, N.Y.

[73] Assignee: Eastman Kodak Company, Rochester, N.Y.

[21] Appl. No.: 351,846

[22] Filed: Feb. 24, 1982

[51] Int. Cl.[3] ..... G03C 5/30

[52] U.S. Cl. ..... 430/465; 430/450; 430/467; 430/484; 430/493; 430/955

[58] Field of Search ..... 430/955, 959, 960, 443, 430/468, 469, 484, 493, 465, 467, 450

[56] References Cited

U.S. PATENT DOCUMENTS

| | | | |
|---|---|---|---|
| 2,030,336 | 2/1936 | Ulrich | 430/484 |
| 2,304,925 | 12/1942 | Jelley | 95/88 |
| 2,306,923 | 12/1942 | Wood | 430/484 |
| 2,444,803 | 7/1948 | Bean | 430/465 |
| 3,574,619 | 4/1971 | Surash | 96/55 |
| 3,615,496 | 10/1971 | Kanous et al. | 96/55 |
| 3,615,497 | 10/1971 | Fassbender | 430/467 |
| 3,814,606 | 6/1974 | Ozawa et al. | 96/66 |

OTHER PUBLICATIONS

H. Soling and Carl Faurholt, Dansk. Tids. Farm, 25, 89–101, 1951.

Lloyd D. Taylor, J. Michael Grasshoff and Milan Pluhar, J. Org. Chem., vol. 43, No. 6, 1197–1200, 1978.

*Primary Examiner*—Mary F. Downey

*Attorney, Agent, or Firm*—Alfred P. Lorenzo

[57] ABSTRACT

Sparingly-soluble alcohols, such as benzyl alcohol, which function to enhance photographic coupling efficiency are incorporated in photographic color developing solutions by the use of solid water-soluble alcohol-precursor compounds. The solid precursor compounds, which can be advantageously utilized as components of an all-solid photographic processing kit, comprise a solubilizing group which is cleaved by the alkaline environment of the color developing solution to form the sparingly-soluble alcohol. Examples of such solid precursor compounds which are especially advantageous in the preparation of color developing solutions are the alkali metal monobenzylcarbonates and the alkali metal monobenzylsulfites.

24 Claims, No Drawings

METHOD AND COMPOSITION FOR PREPARATION OF PHOTOGRAPHIC COLOR DEVELOPING SOLUTIONS

FIELD OF THE INVENTION

This invention relates in general to photography and in particular to photographic color developing solutions. More specifically, this invention relates to the preparation of working strength photographic color developing solutions and to the packaging, transportation, storage and use of the photographic processing agents and compositions from which such solutions are prepared.

BACKGROUND OF THE INVENTION

The formation of color photographic images by the image-wise coupling of oxidized primary aromatic amino developing agents with color forming or coupling compounds to form indoaniline, indophenol, and azomethine dyes is well known. In these processes, the subtractive process of color formation is ordinarily used and the image dyes customarily formed are cyan, magenta, and yellow, the colors that are complementary to the primary colors, red, green, and blue, respectively. Usually, phenol or naphthol couplers are used to form the cyan dye image; pyrazolone or cyanoacetyl derivative couplers are used to form the magenta dye image; and acylacetamide couplers are used to form the yellow dye image.

In these color photographic systems, the color-forming coupler may be either in the developer solution or incorporated in the light-sensitive photographic emulsion layer so that, during development, it is available in the emulsion layer to react with the color developing agent that is oxidized by silver image development. Diffusible couplers are used in color developer solutions. Nondiffusing couplers are incorporated in photographic emulsion layers. When the dye image formed is to be used in situ, couplers are selected which form nondiffusing dyes. For image transfer color processes, couplers are used which will produce diffusible dyes capable of being mordanted or fixed in the receiving sheet.

It is well known to incorporate sparingly-soluble alcohols in photographic color developing solutions which contain primary aromatic amino color developing agents. They are used to promote the reaction of the developing agent with the dye-forming couplers, i.e., to enhance coupling efficiency. Such alcohols are sometimes referred to as "development accelerators" or "development boosters". As indicated by the patent literature, for example, U.S. Pat. Nos. 2,304,925 and 3,814,606, benzyl alcohol is particularly effective for this purpose.

The use of sparingly soluble alcohols, such as benzyl alcohol, in photographic color developing solutions, to enhance coupling efficiency, has long presented a very difficult problem because of the poor solubility characteristics of these compounds. Thus, for example, dissolution of benzyl alcohol in the developing solution tends to be very slow and requires extensive stirring and/or heating. Moreover, the difficulties involved in dissolving benzyl alcohol can result in the formation of "tar" in the developing solution as a consequence of inadequate mixing and dissolution.

One approach to the problem of incorporating benzyl alcohol in photographic color developing solutions is to package the benzyl alcohol in the form of an aqueous liquid concentrate by utilizing a glycol, such as ethylene glycol, to solubilize the benzyl alcohol. This technique is disclosed in Surash, U.S. Pat. No. 3,574,619, issued Apr. 13, 1971. As described in this patent, to form the working strength developing solution the liquid concentrate containing the benzyl alcohol is admixed with one or more other liquid concentrates, containing the other ingredients of the developer formulation, and diluted with water. For convenience, all of the required liquid concentrates are typically packaged together in the form of a photographic processing kit. A second approach is to form an aqueous dispersion of the benzyl alcohol by use of an emulsifying agent such as hydroxyethyl cellulose. This technique is described in Kanous and Fassbender, U.S. Pat. No. 3,615,496, issued Oct. 26, 1971.

While the aforesaid prior art methods are effective for the purposes intended, they are costly and complicated because of the need to form liquid concentrates and do not always provide as easy a procedure for forming a tar-free working strength color developing solution as would be desirable. Thus, it is an objective of this invention to provide an improved and simplified technique whereby sparingly soluble alcohols, such as benzyl alcohol, can be incorporated in a photographic color developing solution in a simple and effective manner.

SUMMARY OF THE INVENTION

In accordance with this invention, sparingly-soluble alcohols, such as benzyl alcohol, are incorporated in photographic color developing solutions by the use of a solid water-soluble alcohol-precursor compound which dissolves readily in the developing solution and, upon dissolution, generates the alcohol. The precursor compounds are compounds which comprise a solubilizing group which is cleaved by the alkaline environment of the color developing solution to form the sparingly-soluble alcohol. To prepare a working strength color developing solution, the solid precursor compound is admixed with the other ingredients of the solution, which may be either solids or liquids, and the resulting mixture is diluted with the appropriate amount of water. In packaging the components of the color developing composition in kit form, use of the solid precursor compound permits the preparation of an all-solid processing kit, i.e., each of the various parts can be in the form of a finely-divided solid, and such a form of packaging has many advantages, as will be hereinafter described. If desired, the kit can be one in which some parts are in the form of liquid concentrates and other parts, including the part comprising the alcohol precursor, are in the form of a finely-divided solid, but an all-solid kit is generally most advantageous.

DESCRIPTION OF THE PREFERRED EMBODIMENTS

The primary aromatic amino color developing agents that can be utilized in the compositions and methods of this invention are well known and widely used in a variety of color photographic processes. They include aminophenols and p-phenylenediamines. They are usually used in the salt form, such as the hydrochloride or sulfate, as the salt form is more stable than the free amine, and are generally employed in concentrations of from about 0.1 to about 20 grams per liter of working strength developing solution and more preferably from about 0.5 to about 10 grams per liter of working strength developing solution.

Examples of aminophenol developing agents include o-aminophenol, p-aminophenol, 5-amino-2-hydroxytoluene, 2-amino-3-hydroxy-toluene, 2-hydroxy-3-amino-1,4-dimethylbenzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride;

4-N,N-diethyl-2-methylphenylenediamine monohydrochloride;

4-(N-ethyl-N-2-methanesulfonylaminoethyl)-2-methyl-phenylenediamine sesquisulfate monohydrate;

4-(N-ethyl-N-2-hydroxyethyl)-2-methylphenylenediamine sulfate;

4-N,N-diethyl-2,2'-methanesulfonylaminoethyl-phenylenediamine hydrochloride; and the like.

An especially preferred class of p-phenylenediamine developing agents are those containing at least one alkylsulfonamidoalkyl substituent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxyalkyl-p-phenylenediamines. These developing agents are described in U.S. Pat. Nos. 3,656,950 and 3,658,525 and can be represented by the formula:

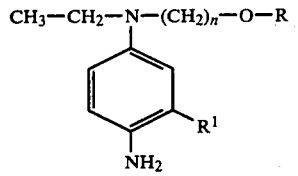

where n is an integer having a value of from 2 to 4, R is alkyl of from 1 to 4 carbon atoms, and $R^1$ is alkyl of from 1 to 4 carbon atoms or alkoxy of from 1 to 4 carbon atoms. Illustrative examples of these developing agents include the following compounds:

N-ethyl-N-methoxyethyl-3-methyl-p-phenylenediamine,

N-ethyl-N-mthoxybutyl-3-methyl-p-phenylenediamine,

N-ethyl-N-ethoxyethyl-3-methyl-p-phenylenediamine,

N-ethyl-N-methoxyethyl-3-n-propyl-p-phenylenediamine,

N-ethyl-N-methoxyethyl-3-methoxy-p-phenylenediamine,

N-ethyl-N-butoxyethyl-3-methyl-p-phenylenediamine, and the like.

Working strength photographic color developing solutions are alkaline solutions. Any of a variety of alkaline agents can be used to provide the required alkalinity. Useful alkaline agents include, for example, hydroxides, carbonates, phosphates, amines, borates, and the like.

In addition to the primary aromatic amino color developing agent, the alkaline agent, and the sparingly-soluble alcohol, the developing solutions of this invention can also contain any of the various components that are ordinarily incorporated in photographic color developing solutions, for example, materials such as alkali metal sulfites, alkali metal bisulfites, alkali metal thiocyanates, alkali metal bromides, chlorides or iodides, hydroxylamines, thickening agents, solubilizing agents, sequestering agents, brightening agents, wetting agents, stain reducing agents, and so forth. The pH of the working strength developing solution is above 7 and most typically about 10 to about 13.

Sparingly-soluble alcohols used to enhance coupling efficiency are typically incorporated in working strength color developing solutions in an amount of from about 1 to about 30 grams per liter. Accordingly, the solid alcohol precursor compound utilized in accordance with this invention is typically employed in an amount sufficient that, upon cleavage in the alkaline developing solution, it will form the alcohol in an amount within this range.

The solid alcohol-precursor compounds described herein can be used in a number of different ways to facilitate the preparation of working strength color developing solutions. For example, in bulk mixing operations in which the working strength developing solution is prepared by the photofinisher from its individual components, it is highly advantageous to utilize the alcohol precursor rather than the alcohol itself, because the precursor dissolves in a much faster and easier manner. Thus, by use of the precursor comound, the need for heating of the solution and/or for tedious and time consuming mixing is greatly reduced. The precursor compounds are also highly advantageous in the formulation of color developer processing kits. In such kits, the components that make up the complete developer are separated into two or more separately packaged materials, so as to avoid deleterious physical and/or chemical interactions that might take place between the various processing agents. The individually packaged materials can be individual solid processing agents, mixtures of two or more solid processing agents, or liquid concentrates comprising one or more processing agents dissolved or dispersed in a small amount of liquid medium. In forming the working strength color developing solution, all of the separately packaged materials making up the kit are blended together in the appropriate proportions and diluted with the required amount of water. The solid precursor compounds described herein greatly facilitate the preparation of processing kits, and are especially advantageous in that they can reduce the total number of required parts in such kits. They can be packaged individually, in finely-divided solid form, or in admixture with other solid processing agents. Some of the separately packaged materials can be liquid concentrates or all can be in the form of solids. The ability to prepare an "all-solid" or "all-powder" color developer processing kit is especially desirable. However, prior methods of utilizing benzyl alcohol, such as by the use of ethylene glycol or hydroxyethyl cellulose as previously described herein, have been limited to the formulation of a liquid concentrate. The packaging of an "all-solid" system has significant advantages in lower manufacturing costs, less expensive packaging materials, improved shelf life, and reduced bulk and weight, which results in lower shipping and storage costs.

Heretofore, the preparation of an all-solid processing kit for a benzyl-alcohol containing color developing solution has not been feasible because benzyl alcohol is a liquid at room temperature. It has been necessary to package the benzyl alcohol in the form of a liquid concentrate, usually with the aid of a solubilizing agent, such as ethylene glycol, or an emulsifying agent, such as hydroxyethyl cellulose. Thus, even though all of the other ingredients of a typical color developing solution are materials which are solid at room temperature, the advantages of an all-solid processing kit could not be achieved. The achievement of these advantages is one of the most important benefits of this invention.

A very significant advantage of the present invention resides in the fact that the alcohol precursor compound dissolves very readily and is thereby uniformly distributed throughout the entire body of developing solution, whereby the alcohol formed by cleavage of the precursor compound is also uniformly distributed throughout the entire body of developing solution.

The alcohol precursor compounds utilized in accordance with this invention are comprised of a sparingly-soluble alcohol moiety and an alkali-cleavage solubilizing group, i.e., a group which increases the solubility of the alcohol but which readily cleaves in the aqueous alkaline working strength developing solution to yield the alcohol and one or more by-products. These by-products can be compounds which are inert with respect to the components and functioning of a color developing solution, and thus have no adverse effect thereon, or they can be materials which serve as useful agents in the developing solution.

The solid water-soluble alcohol precursor compounds utilized in this invention can be represented by the formula:

A-Z where A is the nucleus of a sparingly-soluble alcohol, i.e., the residue resulting from deprotonization of a sparingly-soluble alcohol, and Z is an alkali-cleavable solubilizing group.

Examples of alkali-cleavable solubilizing groups, represented by "Z" in the above formula, include the carbonate group and the sulfite group.

While benzyl alcohol is usually used in photographic color developing solutions for the purpose of enhancing coupling efficiency, and, accordingly, benzyl alcohol precursors represent the preferred species of the present invention, many other sparingly-soluble alcohols can also be used for this purpose. These alcohols can be aliphatic alcohols, cycloaliphatic alcohols, or aromatic alcohols. Particularly useful sparingly-soluble alcohols are those containing 5 to 15 carbon atoms. Examples of such sparingly-soluble alcohols, represented by "A" in the above formula, include the following:

benzyl alcohol,
o-hydroxybenzyl alcohol,
tert-pentyl alcohol,
cyclohexanol,
2-benzyloxyethanol,
anisyl alcohol,
2-phenoxyethanol,
1-pentanol,
phenylethyl alcohol,
p-tolylcarbinol,
1-hexanol,
m-phenylphenol,
and the like.

A preferred class of alcohol precursor compounds for use in this invention are compounds of the formula:

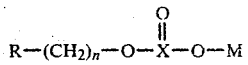

wherein R is an aliphatic or aromatic hydrocarbyl radical, n is an integer of from 1 to 8, X is selected from the group consisting of carbon and sulfur, and M is ammonium or an alkali metal.

A particularly preferred class of alcohol precursor compounds for use in this invention are carbonates of the formula:

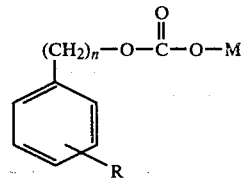

wherein n is an integer of from 1 to 3, R is hydrogen or an alkyl group of 1 to 4 carbon atoms, and M is ammonium or an alkali metal. Especially preferred are the alkali metal monobenzylcarbonates, particularly potassium monobenzylcarbonate.

Another particularly useful class of alcohol precursor compounds are sulfites of the formula

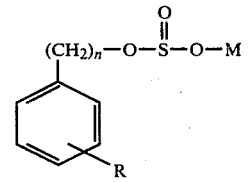

wherein n is an integer of from 1 to 3, R is hydrogen or an alkyl group of 1 to 4 carbon atoms, and M is ammonium or an alkali metal. Especially preferred are the alkali metal monobenzylsulfites, particularly sodium monobenzylsulfite.

Potassium monobenzylcarbonate is especially useful in the present invention. It hydrolyzes very rapidly in water to give benzyl alcohol and potassium carbonate, both of which are useful components of photographic color developing solutions. It is easily and conveniently prepared by adding carbon dioxide to a solution of potassium hydroxide in benzyl alcohol in accordance with the following reaction equation:

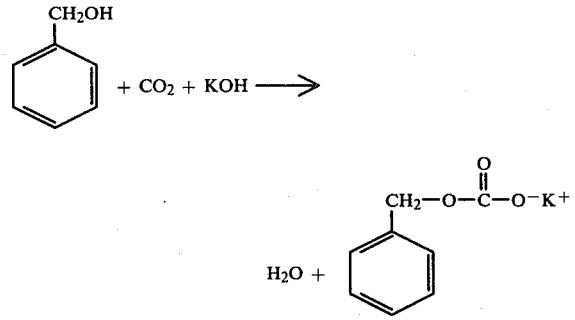

Another particularly useful alcohol-precursor is sodium monobenzylsulfite. This compound can be prepared by adding sodium metal to an excess of benzyl alcohol and then bubbling sulfur dioxide gas through the solution. The sodium monobenzylsulfite dissolves readily in water to release benzyl alcohol and sodium bisulfite, both of which are useful components of photographic color developing solutions.

Mixtures of two or more different classes of the alcohol precursor compounds can be used, if desired, for example a mixture of a carbonate and a sulfite.

The invention is further illustrated by the following examples of its practice.

EXAMPLE 1

The ingredients described below were utilized in the preparation of a photographic color developing solution. These ingredients, all of which are solids at room temperature, were mixed together in the quantities indicated and dissolved in sufficient water to give one liter of solution.

| Component | Amount (grams) |
|---|---|
| Potassium monobenzylcarbonate | 34.72 |
| Lithium chloride | 2.04 |
| Hydroxylamine sulfate | 4.00 |
| Potassium sulfite | 2.04 |
| Dipotassium salt of 1-hydroxy-ethylidene-1,1-diphosphonic acid | 0.88 |
| Color developing agent* | 6.50 |
| Potassium hydroxide | 12.60 |
| Potassium carbonate | 7.32 |

*4-(N—ethyl-N—2-methanesulfonylaminoethyl)-2-methyl-phenylenediamine sesquisulfate monohydrate.

Analysis of the developing solution indicated that it had a pH of 10.23 and contained 17.3 milliliters per liter of benzyl alcohol. Photographic testing of this developing solution indicated that it gave substantially equivalent results to a similar developing solution in which the benzyl alcohol was incorporated by thorough and prolonged stirring to bring about dissolution thereof.

EXAMPLE 2

A working strength photographic color developing solution can be prepared by admixing the ingredients listed below, adjusting the pH to 10.65±0.05 with 45% potassium hydroxide solution, and diluting with water to a volume of one liter.

| Component | Amount |
|---|---|
| Water | 800 milliliters |
| Sequestering agent* | 0.8 milliliters |
| Lithium sulfate | 2.0 grams |
| 2,2'-Ethylenedithiodiethanol | 0.2 grams |
| Hydroxylamine sulfate | 2.6 grams |
| Color developing agent** | 4.6 grams |
| Ethylene glycol | 10.0 milliliters |
| Potassium hydroxide (45% solution) | 4.7 milliliters |
| Potassium monobenzyl-carbonate | 23.4 grams |
| Sodium monobenzylsulfite | 7.5 grams |
| Potassium carbonate | 23.4 grams |

*A 60% by weight aqueous solution of the dipotassium salt of 1-hydroxyethylidene-1,1-diphosphonic acid.
**4-(N—ethyl-N—2-methanesulfonylaminoethyl)-2-methyl-phenylenediamine sesquisulfate monohydrate.

In the formulation described above, the potassium monobenzylcarbonate cleaves to form potassium carbonate and benzyl alcohol and the sodium monobenzylsulfite cleaves to form sodium bisulfite and benzyl alcohol, thereby providing appropriate quantities in the developing solution of both benzyl alcohol and the sulfite ion.

The invention has been described in detail with particular reference to preferred embodiments thereof, but it will be understood that variations and modifications can be effected within the spirit and scope of the invention.

We claim:

1. A method of preparing a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said method comprising admixing together and dissolving in an aqueous medium a plurality of photographic processing agents, one of said agents being a primary aromatic amino color developing agent, a second of said agents being an alkaline agent, and a third of said agents being a solid water-soluble alkali-cleavable precursor of a sparingly-soluble alcohol that is cleaved by the alkaline environment of said color developing solution, whereby said sparingly-soluble alcohol is formed when said plurality of processing agents are admixed together and dissolved in said aqueous medium.

2. A method of preparing a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said method comprising admixing together and dissolving in an aqueous medium a plurality of photographic processing agents, one of said agents being a primary aromatic amino color developing agent, a second of said agents being an alkaline agent, and a third of said agents being a solid water-soluble alkali-cleavable precursor of a sparingly-soluble alcohol that is cleaved by the alkaline environment of said color developing solution, whereby said sparingly-soluble alcohol is formed when said plurality of processing agents are admixed together and dissolved in said aqueous medium, said precursor being selected from the group consisting of carbonates of the formula:

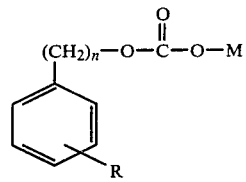

wherein n is an integer of from 1 to 3, R is hydrogen or an alkyl group of 1 to 4 carbon atoms, and M is ammonium or an alkali metal, and sulfites of the formula:

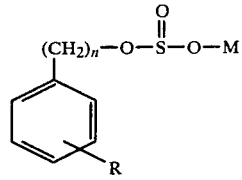

wherein n is an integer of from 1 to 3, R is hydrogen or an alkyl group of 1 to 4 carbon atoms, and M is ammonium or an alkali metal.

3. A method as claimed in claim 2 wherein said precursor is a carbonate of the formula:

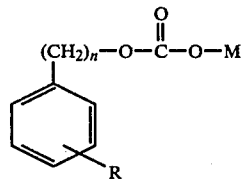

wherein n is an integer of from 1 to 3, R is hydrogen or an alkyl group of 1 to 4 carbon atoms, and M is ammonium or an alkali metal.

4. A method as claimed in claim 2 wherein said precursor is an alkali metal or ammonium monobenzylcarbonate.

5. A method as claimed in claim 2 wherein said precursor is potassium monobenzylcarbonate.

6. A method as claimed in claim 2 wherein said precursor is a sulfite of the formula:

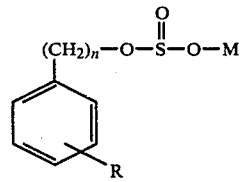

wherein n is an integer of from 1 to 3, R is hydrogen or an alkyl group of 1 to 4 carbon atoms, and M is ammonium or an alkali metal.

7. A method as claimed in claim 2 wherein said precursor is an alkali metal or ammonium monobenzylsulfite.

8. A method as claimed in claim 2 wherein said precursor is sodium monobenzylsulfite.

9. A method of incorporating a sparingly-soluble alcohol in a working strength aqueous alkaline photographic color developing solution, which method comprises dissolving in said solution a solid water-soluble alkali-cleavable precursor of a sparingly-soluble alcohol that is cleaved by the alkaline environment of said color developing solution to yield said sparingly-soluble alcohol.

10. A photographic processing concentrate in the form of a finely-divided solid that is useful in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said concentrate comprising a primary aromatic amino color developing agent, an alkaline agent, and a solid water-soluble alkali-cleavable precursor of a sparingly-soluble alcohol that is cleaved by the alkaline environment of said color developing solution to yield said sparingly-soluble alcohol.

11. A photographic processing kit for use in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said kit comprising a plurality of parts, at least one of said parts comprising a primary aromatic amino color developing agent, at least one of said parts comprising an alkaline agent, and at least one of said parts comprising a solid water-soluble alkali-cleavable precursor of a sparingly-soluble alcohol that is cleaved by the alkaline environment of said color developing solution to yield said sparingly-soluble alcohol.

12. An all-solid photographic processing kit for use in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said kit comprising a plurality of parts which are mixed together and dissolved in an aqueous medium to form said working strength color developing solution, each of said parts being in the form of a finely-divided solid, at least one of said parts comprising a primary aromatic amino color developing agent, at least one of said parts comprising an alkaline agent, and at least one of said parts comprising a solid water-soluble alkali-cleavable precursor of a sparingly-soluble alcohol that is cleaved by the alkaline environment of said color developing solution to yield said sparingly-soluble alcohol.

13. An all-solid photographic processing kit for use in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said kit comprising a plurality of parts which are mixed together and dissolved in an aqueous medium to form said working strength color developing solution, each of said parts being in the form of a finely-divided solid, at least one of said parts comprising a primary aromatic amino color developing agent, at least one of said parts comprising an alkaline agent, and at least one of said parts comprising a solid water-soluble alkali-cleavable precursor of a sparingly-soluble alcohol that is cleaved by the alkaline environment of said color developing solution to yield said sparingly-soluble alcohol, said precursor being selected from the group consisting of carbonates of the formula:

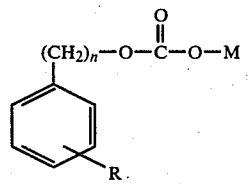

wherein n is an integer of from 1 to 3, R is hydrogen or an alkyl group of 1 to 4 carbon atoms, and M is ammonium or an alkali metal, and sulfites of the formula:

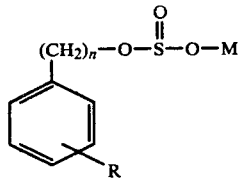

wherein n is an integer of from 1 to 3, R is hydrogen or an alkyl group of 1 to 4 carbon atoms, and M is ammonium or an alkali metal.

14. A processing kit as claimed in claim 13 wherein said precursor is a carbonate of the formula:

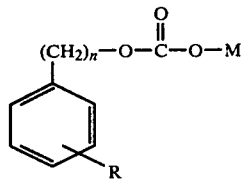

wherein n is an integer of from 1 to 3, R is hydrogen or an alkyl group of 1 to 4 carbon atoms, and M is ammonium or an alkali metal.

15. A processing kit as claimed in claim 13 wherein said precursor is an alkali metal or ammonium monobenzylcarbonate.

16. A processing kit as claimed in claim 13 wherein said precursor is potassium monobenzylcarbonate.

17. A processing kit as claimed in claim 13 wherein said precursor is a sulfite of the formula:

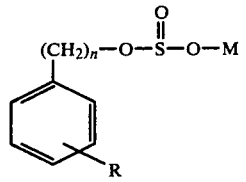

wherein n is an integer of from 1 to 3, R is hydrogen or an alkyl group of 1 to 4 carbon atoms, and M is ammonium or an alkali metal.

18. A processing kit as claimed in claim 13 wherein said precursor is an alkali metal or ammonium monobenzylsulfite.

19. A processing kit as claimed in claim 13 wherein said precursor is sodium monobenzylsulfite.

20. A method of incorporating a sparingly-soluble alcohol in a working strength aqueous alkaline photographic color developing solution, which method comprises dissolving in said solution a solid water-soluble alkali-cleavable precursor of a sparingly-soluble alcohol that is cleaved by the alkaline environment of said color developing solution to yield said sparingly-soluble alcohol, said precursor being selected from the group consisting of carbonates of the formula:

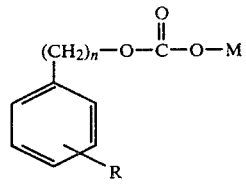

wherein n is an integer of from 1 to 3, R is hydrogen or an alkyl group of 1 to 4 carbon atoms, and M is ammonium or an alkali metal, and sulfites of the formula:

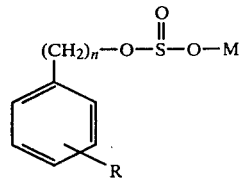

wherein n is an integer of from 1 to 3, R is hydrogen or an alkyl group of 1 to 4 carbon atoms, and M is ammonium or an alkali metal.

21. A photographic processing concentrate in the form of a finely-divided solid that is useful in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said concentrate comprising a primary aromatic amino color developing agent, an alkaline agent, and a solid water-soluble alkali-cleavable precursor of a sparingly-soluble alcohol that is cleaved by the alkaline environment of said color developing solution to yield said sparingly-soluble alcohol, said precursor being selected from the group consisting of carbonates of the formula:

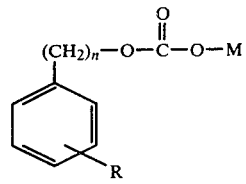

wherein n is an integer of from 1 to 3, R is hydrogen or an alkyl group of 1 to 4 carbon atoms, and M is ammonium or an alkali metal, and sulfites of the formula:

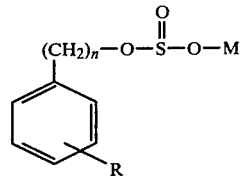

wherein n is an integer of from 1 to 3, R is hydrogen or an alkyl group of 1 to 4 carbon atoms, and M is ammonium or an alkali metal.

22. A photographic processing kit for use in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said kit comprising a plurality of parts, at least one of said parts comprising a primary aromatic amino color developing agent, at least one of said parts comprising an alkaline agent, and at least one of said parts comprising a solid water-soluble alkali-cleavable precursor of a sparingly-soluble alcohol that is cleaved by the alkaline environment of said color developing solution to yield said sparingly-soluble alcohol, said precursor being selected from the group consisting of carbonates of the formula:

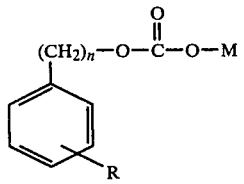

wherein n is an integer of from 1 to 3, R is hydrogen or an alkyl group of 1 to 4 carbon atoms, and M is ammonium or an alkali metal, and sulfites of the formula:

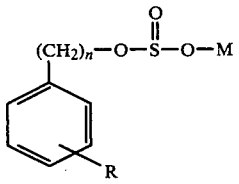

wherein n is an integer of from 1 to 3, R is hydrogen or an alkyl group of 1 to 4 carbon atoms, and M is ammonium or an alkali metal.

23. An all-solid photographic processing kit for use in the preparation of a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said kit comprising a plurality of parts which are mixed together and dissolved in an aqueous medium to form said working strength color developing solution, each of said parts being in the form of a finely-divided solid, at lea st one of said parts comprising a primary aromatic amino color developing agent, at least one of said parts comprising an alkaline agent, and at least one of said parts comprising a solid water-soluble alkali-cleavable precursor of a sparingly-soluble alcohol that is cleaved by the alkaline environment of said color developing solution to yield said sparingly-soluble alcohol, said precursor having the formula:

$$R-(CH_2)_n-O-\overset{\overset{\displaystyle O}{\|}}{X}-O-M$$

wherein R is a hydrocarbyl radical, n is an integer of from 1 to 8, X is selected from the group consisting of carbon and sulfur, and M is ammonium or an alkali metal.

24. A method of preparing a working strength aqueous alkaline photographic color developing solution that functions to generate image dyes in a photographic element by the coupling reaction of an oxidized color developing agent with a photographic coupler and that contains a sparingly-soluble alcohol which serves to enhance coupling efficiency, said method comprising admixing together and dissolving in an aqueous medium a plurality of photographic processing agents, one of said agents being a primary aromatic amino color developing agent, a second of said agents being an alkaline agent, and a third of said agents being a solid water-soluble alkali-cleavable precursor of a sparingly-soluble alcohol that is cleaved by the alkaline environment of said color developing solution, whereby said sparingly-soluble alcohol is formed when said plurality of processing agents are admixed together and dissolved in said aqueous medium; said precursor having the formula:

$$R-(CH_2)_n-O-\overset{\overset{\displaystyle O}{\|}}{X}-O-M$$

wherein R is a hydroxycarbyl radical, n is an integer of from 1 to 8, X is selected from the group consisting of carbon and sulfur, and M is ammonium or an alkali metal.

* * * * *